United States Patent [19]

Moulton

[11] Patent Number: 4,953,314

[45] Date of Patent: Sep. 4, 1990

[54] INERT GAS LIGHTING SYSTEM AND MEANS THEREFOR

[76] Inventor: Herbert F. Moulton, 4524 W. Marlette, Glendale, Ariz. 85301

[21] Appl. No.: 834,543

[22] Filed: Feb. 28, 1986

[51] Int. Cl.[5] ..... G09F 13/26

[52] U.S. Cl. ..... 40/545

[58] Field of Search ..... 40/545, 544, 543, 542, 40/541; 174/59, 65 R

[56] References Cited

U.S. PATENT DOCUMENTS

| | | | |
|---|---|---|---|
| 1,918,616 | 7/1933 | Hotchner | 40/545 |
| 1,961,735 | 6/1934 | Braun | 40/545 |
| 1,986,009 | 1/1935 | Nelson | 40/545 |
| 2,024,409 | 12/1935 | Wilde | 40/545 |
| 2,173,510 | 9/1939 | Bellows | 40/545 |
| 2,274,682 | 3/1942 | Ford | 40/545 |
| 2,284,309 | 5/1942 | Tschopp | 40/545 |
| 2,823,474 | 2/1958 | Hotchner | 40/545 |
| 4,434,569 | 3/1984 | Minogue | 40/545 |
| 4,460,226 | 7/1984 | Hageman | 40/545 |

FOREIGN PATENT DOCUMENTS

| | | | |
|---|---|---|---|
| 556503 | 2/1960 | Belgium | 40/545 |
| 449977 | 7/1935 | United Kingdom | 40/545 |

*Primary Examiner*—Kenneth J. Dorner
*Assistant Examiner*—J. Hakomaki
*Attorney, Agent, or Firm*—Richard R. Mybeck

[57] ABSTRACT

An inert gas lighting system, which system has a plurality of letters or characters arranged in sequence and a high tension dielectric terminal box operatively disposed between adjacent pairs of said characters. Each box has a terminal block centrally disposed therein for the attachment of high voltage cable leads thereto connecting adjacent letters. The use of thermosetting V5 plastic for the construction of the terminal box enables the entire unit to be molded, sealed and grounded as required. Installation, maintenance and repair of such signage is enhanced.

13 Claims, 1 Drawing Sheet

INERT GAS LIGHTING SYSTEM AND MEANS THEREFOR

INTRODUCTION

The present invention relates to inert gas sign lighting systems and means therefor and more particularly to a high tension terminal box especially useful in wiring the secondary circuit of neon-type tubing in such systems where the use of P-K style electrode housing is mandated by local code.

BACKGROUND OF THE INVENTION

Neon and like inert gas lighting systems which utilize high voltage molecular excitation to activate the gas contained therein are very popular for the identification of businesses, governmental agencies, and like establishments because they provide a brilliant, attractive, and attention getting visual effect. With the increased use and complexity of such signs (herein referred to generally as "neon signs"), there is a need to simplify wiring and structural requirements so that they may be more easily installed, maintained and repaired.

The manufacture and maintenance of neon lighting systems is presently governed by regulations directed to structural integrity and safety. Inert gas excitation provides the color and light associated with so called neon signs which consist of evacuated tubing which is filled with neon or other inert gas to provide the desired color(s) and brilliancy when subjected to a high voltage discharge. The high voltages required to produce the desired lighting effect has heretofore required the use of sturdy structures made from dielectric materials to contain the high voltage. See; Paragraph 600-8A of the National Electric Code (NEC) 1984 edition. Currently commercial light units suffer from frequent deterioration or fracture of the wire. The presence of an open or broken wire is a relatively common occurrence which usually requires the services of a journeyman electrician to locate and replace. The laborious tracing of the circuitry to locate and isolate the defective wire and replace it inevitably requires the system to be completely rebalanced in order to reestablish the original color and brightness of the display.

Heretofor when several letters or characters make up a given display, a plurality of cable members, each adapted to have a P-K style metallic glass lined electrode housing mounted on each end thereof, had to be cut precisely to size, strung through the flex cable or electrometallic tubing, the P-K style housing and carefully and individually secured to the electrode contact at each end thereof. Next, the electrode housing at one end of the cable would be inserted in the socket provided by one letter and the housing at the other end thereof would be connected in a similar manner to the adjacent letter. This operation would be repeated until the entire sequence of characters was connected in series. The transformer associated therewith to produce the 2,000–15,000 volts required in the secondary circuit, would be connected at one terminal to the letter or character first in the sequence and at the other terminal, to the letter last in the sequence to complete the circuit. This process was extremely tricky and tedious, because if the cable is cut a bit too short it was wasted and if it is cut a bit too long, it bunched and became a prime site for a subsequent short.

When a "short" developed in such a wiring scheme, the sign either flickered or went dark. Each cable segment then had to be methodically jumped out, i.e., an auxiliary cable was extended between adjacent electrodes until the offending segment was identified. The defective segment was then removed and replaced. When the procedure did not reveal a defective cable segment, then the individual characters or letters were tested by grounding out the individual circuits to see if they glow. This procedure was time consuming, tedious and, because of the possible need to create new cable segments and mount electrode housings thereto, a journeyman electrician was required to complete the "trouble shoot".

Thus it is apparent that a definite need exists to find better means and methods to wire such high voltage inert gas lighting systems and it is toward that need that the present invention is directed.

SUMMARY OF THE INVENTION

The present invention relates to an inert gas lighting system and to a high voltage splice or terminal box especially suited for use therein. Such a splice has not been heretofore possible. Thus when used in high voltage inert gas lighting systems, the present invention provides unique means which results in the simplification of the wiring of such signs which is useful, not only in the manufacture of such signs, but in their installation and repair. The novel wiring system which results herefrom not only reduces the expense associated with the manufacture of the system, it substantially reduces the cost of installation, maintenance and repair. Furthermore, the present invention provides for increased product dependability by providing an accepted method of wire replacement and splicing which can be efficiently and safely accomplished with no more than an apprentice on the job.

More particularly, the present invention relates to means and methods of installing and wiring high voltage inert gas-type signage in which a novel high tension terminal box is operatively interposed between each pair of adjacent characters or letters in a sequence whereby the electrical characteristic of any run between adjacent characters can be readily measured and the defective cable promptly isolated and replaced.

The terminal box of the present invention is fabricated from a non combustible dielectric material such as metal, glass, ceramic and the like preferably the new thermo set V-5 fire resistant plastic materials. Each housing comprises a cylindrical side wall, a base plate, and a detachable cover plate. A suitable connector bar having two binder posts is mounted therewithin on a central terminal block disposed in fully insulated relationship to said side wall and said plates whereby the operative characteristics of any cable leg spliced thereby can be quickly and readily measured.

Accordingly, a principal object of the present invention is to develop novel means and methods of wiring inert gas (neon-type) lighting systems in which a defective cable leg can be quickly detected and readily replaced.

Another object of the present invention is to provide a new and improved high tension terminal box which can be readily installed intermediate each pair in a sequence of letters and characters so that the electric characteristic of the cables secured thereto can be quickly and easily measured and a defective cable leg readily isolated and replaced.

A further object of the present invention is to provide new and improved means and methods for constructing and installing inert-gas lighting systems which enables a single apprentice to service and repair such signage with a minimum of time and expense.

These and still further objects as shall hereinafter appear are readily fulfilled by the present invention in a remarkably unexpected fashion as will be readily discerned from the following detailed description of the preferred embodiments thereof, especially when read in conjunction with the accompanying drawing in which like parts bear like indicia throughout the several views.

THE DRAWING

DESCRIPTION OF PREFERRED EMBODIMENTS

Figure 1:
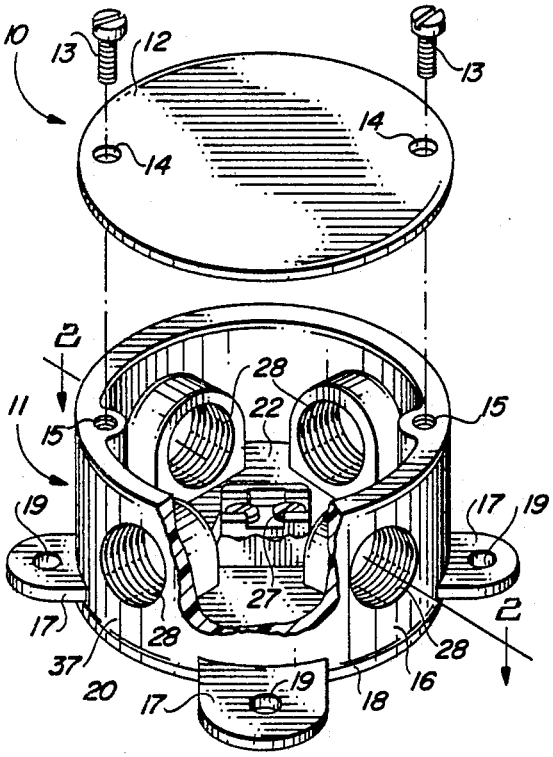
FIG. 1 is an exploded isometric view of a terminal box employing the present invention.
Figure 2:
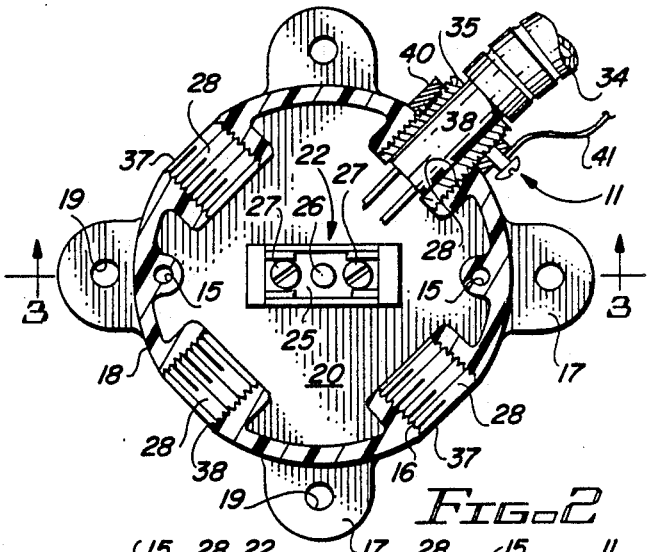
FIG. 2 is a cross-section taken along line 2—2 of FIG. 1.
Figure 3:
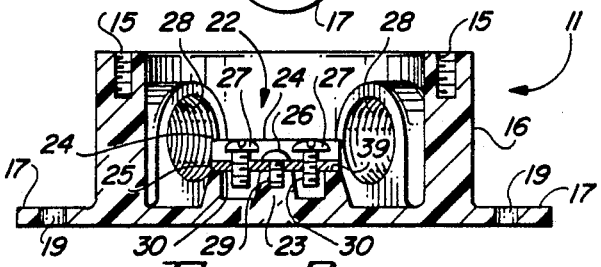
FIG. 3 is a cross-section taken along line 3—3 of FIG. 2.

Referring to the drawing, and particularly FIGS. 1–3 thereof, the high tension terminal box of the present invention, indicated by general reference 10, comprises a housing member 11 and a cover plate 12 detachably secured to housing member 11 with suitable fasteners such as self-tapping screws 13 which pass through cover holes 14 into threaded seated engagement within bores 15.

As shown, housing member 11 comprises a generally cylindrical side wall 16 having a plurality of flanged ears 17 extending outwardly therefrom in equispaced disposition around the perimeter 18 of wall 16. Each flanged ear 17 has an opening 19 defined therethrough for a purpose to be hereinafter described.

A circular bottom plate 20 is disposed beneath side wall 16 and, preferably, is integrally formed thereto to create an unitary structure therewith.

Centrally disposed within housing member 11, preferably along a diameter thereof, is a terminal block 22 having a base portion 23 integrally formed with or suitably attached to plate 20 and presenting an upper support surface 24 to which a suitable metal contact plate 25, preferably brass, is secured by drive screw 26. A binder bolt 27 is positioned at each end of plate 25 to provide means for effecting a cable connection thereto as will be hereinafter described in detail. Drive screw 26 is disposed in threaded engagement within a hole 29 defined in block 22 while bolts 27 pass into corresponding holes 30 for threaded engagement therewithin.

A plurality of threaded access openings 28 are defined in and through cylindrical side wall 16 to provide means for introducing external wires into housing member 11 for connection to terminal block 22 as will hereafter be described. Each access opening 28 is disposed in equispaced relationship about perimeter 18 intermediate an adjacent pair of flanged ears 17. As will appear, openings 28 which are not employed in a given hookup will be closed with a conventional threaded plug (not shown). Each opening 28 is provided with a flat face 37 to create a complete surface-to-surface engagement between face 37 and the complementary surface 38 of a threaded flex connector 35 whose function will be hereinafter described.

Figure 4:
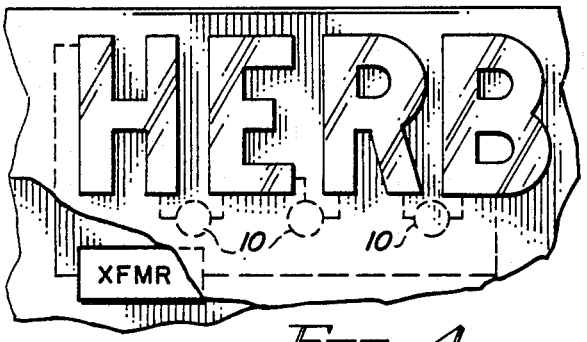
FIG. 4 is a frontal elevation of an inert gas display sign embodying the present invention.

Terminal box 10 is employed in the installation of an inert-gas sign by operatively interposing a separate box 10 intermediate each pair of adjacent letters such, for example, as the letters "R" and "B" in FIG. 4.

In the manufacture and assembly of box 10, housing member 11 including bottom plate 20 and base portion 23 of terminal block 22 are preferably formed of metal or other noncombustible materials such as glass, ceramic and the like. A highly suitable material for molding these parts is a thermosetting 5V plastic such as POLYLITE® 30001, a polyester molding compound produced by Reichhold Chemicals, Inc., Carteret, N.J. Such plastics are rated 94-5 V (herein "5 V") by Underwriters Laboratories, Inc. (UL) when subjected to UL's tests for flammability of plastic materials, hence their designation. Preferably, housing member 11, bottom plate 20 and base portion 23 will be molded as an integral piece when the 5 V thermosetting fire resistant plastic is used. When so formed, threaded access openings 28, bores 15, holes 19 and complementary hole 29 are formed in the mold. Holes 30, in which binder posts 27 are operatively installed; will be drilled into terminal block 22 using conventional tools when the formed piece is removed from the mold.

Cover plate 12 is generally formed separately using the same material as used for housing member 11, such as metal, glass, ceramic or 5 V thermosetting plastic. Bolt holes 14 are formed through cover plate 12 to register with bores 15 at the time the plate 12 is formed.

Electrically conductive metal plate, e.g., brass plate 25 is secured to terminal block 22 by activating drive screw 26 into hole 29. Binder posts 27 are introduced into holes 30 either into the upper surface 39 of terminal block 22 or upwardly through base portion 23 in which case suitable hex nuts (not shown) will be cooperatively disposed upon the exposed threads of binders posts 27 which, when tightened down, will complete the circuitry as will be hereafter described. Metallic plate 25 interconnects binder posts 27 and the circuitry connected thereto.

At the job site where a neon-like sign having multiple characters (see H-E-R-B in FIG. 4) is being installed, the secondary circuit comprises a transformer (marked "XFMR" in FIG. 4) which is connected from one terminal to the first character in the series, e.g., "H-" and from its other terminal to the last character in the series, e.g., "-B". Intermediate each of the letters in series, e.g., H-E, E-R, and R-B, a high tension terminal box 10 is installed by suitable fasteners passing through flange openings 19 into the structure upon which the sign is mounted to secure box 10 thereto.

Figure 5:
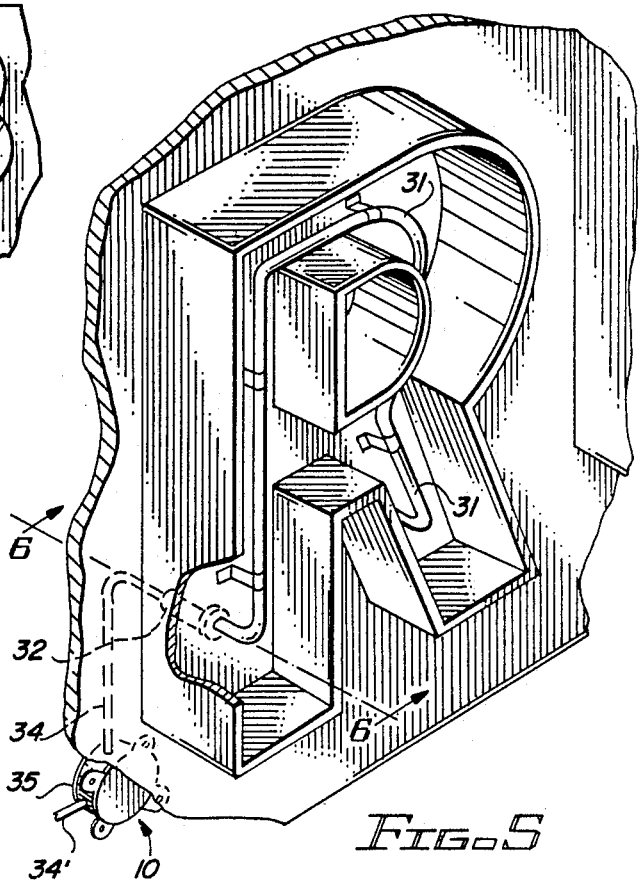
FIG. 5 is an enlarged isometric view of a single character from the sign of FIG. 4.
Figure 6:
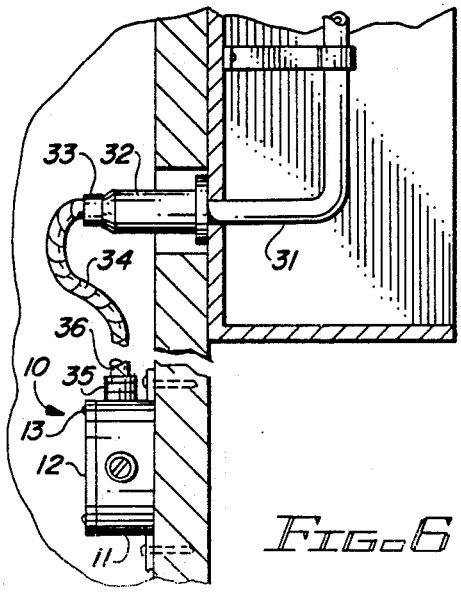
FIG. 6 is a cross-section taken along line 6—6 of FIG. 5.

As shown in FIGS. 5 and 6, each letter contains glass tubing 31 which terminates at each end thereof in an electrode socket 32 into which a PK style insulated electrode housing 33 may be secured. A suitable high tension cable 34, such as GTO cable passed through a flex cable raceway for high voltage wire, is securely connected at one end within the P-K style electrode housing 33 in the usual manner and extends outwardly therefrom for passage through the threaded flex connector 35 adjacent the distal end 36 of cable 34 for attachment to one binder post 27 in box 10. A similar cable 34' extends from a similar electrode socket 32' in the adjacent letter for connection to the other binder post 27 in box 10. A suitable ground wedge 40 will be installed on the threads of each flex connector 35 in partial circumscription about the high voltage wire prior to the final tightening of the flex connector 35 to terminal box 22. A suitable bond wire 41 is connected to each ground wedge and extends therebetween. Brass plate 25, which as indicated, electrically connects binder posts 27, 27 completes the series connection between cables 34 and 34' and hence the adjacent letters. When each box is fully connected to two adjacent cables and the appropriate plugs tightly secured in the unused access openings 28, the corresponding cover plate 12 is secured in its appropriate position by passing self-tapping screws 13 through holes 14 for secured threaded engagement in bores 15.

The procedure just described is repeated until each pair of adjacent letters is similarly connected to a terminal box 10 operatively interposed therebetween and the entire transformer circuit is complete. To comply with most local codes, a pair of ground wedges 40 and an interconnecting bond wire 41 will be mounted to the exterior of each box 10.

Once installed, a defect in the hook up, as evidenced by a flickering or total failure of the lightening, can be quickly and easily isolated by methodically removing cover plate 12 from each box 10 and placing a conventional ammeter across the exposed binder posts 27, 27 to measure the continuity therethrough. When the failure is detected, the defective cable leg 34 at that box is readily replaced and the working circuit restored without the cumbersome need to independently fit both ends of a precisely cut GTO cable into PK style electrode housings thereby substantially reducing both the labor and the material necessary to restore the light to its operating condition.

It is of course understood that housing member 11 is not restricting to the generally cylindrical shape described but can have an octagonal or other suitable configuration without departing from the teaching embraced herein.

The designation "5 V", referred to above, is used to designate those materials which successfully meet the criteria defined by UL in UL publication no. 94 "Tests for Flammability of Plastic Materials". The term 5 V plastic is well known in the art and adequately identifies the material used herein. Such materials are sold by the chemical producers in granular form and can be molded by compression, transfer or injection. Among the polyesters available which comply with the UL94-5 V rating standards and are therefore suitable for use herein are those polyesters designated 30000, 30001 and 30003-1 (Reichhold), Velox® 420 SE (General Electric), PETLON® (Mobay) and like thermosetting plastics. Velox®, a polybutylene terephthalate is particularly suitable.

The term "non-combustible" as defined by the Uniform Fire Code for building construction materials means a material which in the form in which it is used is either (a) material of which no part will ignite and burn when subjected to fire or (b) material having a structural base of non-combustible as defined in (a) with a surfacing material not over ⅛ inch thick which has a flame spread rating of 50 or less.

From the foregoing it is apparent that a novel high tension inert gas lighting system and means therefor has been herein described and illustrated which fulfills all of the aforestated objectives in a remarkably unexpected fashion. It is of course understood that such modifications, alterations and adaptations as may readily occur to the artisan when confronted with this disclosure are intended within the spirit of this invention which is limited only by the scope of the claims appended hereto.

What is claimed is:

1. A system for wiring the secondary circuitry in an inert gas sign set-up without requiring an external sign cabinet to protect the set up from adverse weather conditions, said system comprising: a plurality of discrete sign characters disposed in a sequence, each of said characters having a tube of preselected shape operatively associated therewith, each said tube having a first end and a second end and being filled with an inert gas capable of glowing when excited by the application of high electrical voltage thereto; a plurality of discrete cable means, each having a proximal end and a distal end, each said proximal end of each said cable means being operatively connected to a different one of said tube first ends and said tube second ends; a high tension terminal box operatively interposed between each pair of adjacent sign characters in said sequence and having a housing member having a sidewall and a bottom, access means defined through said sidewall in equispaced relationship to each other, a terminal block centrally disposed within said housing member in spaced insulated relationship to said sidewall, said terminal block having first and second binder posts disposed therein in electrical communication with each other, each said binder post being adapted to receive and secure said distal end of said cable means extending from a different one of said adjacent sign characters to serially connect a pair of adjacent sign characters therethrough when said distal ends of said cables are secured thereto; a high voltage transformer having two posts; cable means connecting one of said transformer posts to said first end of said tube in the first character in said sequence and connecting the other of said posts to the said second end of said tube in the final of said characters in said sequence to complete the circuit through said sequence; and means for controlling said transformer to selectively energize and deenergize said inert gas in said tubing.

2. An inert gas lighting system according to claim 1 in which each said cable means has a P-K style insulated electrode holder operatively secured to said proximal end thereof and a threaded flex connector adjacent the distal end thereof.

3. An inert gas lighting system according to claim 2 in which said electrode holder is operatively connected to said tube in said sign character and said threaded flex connector having a ground wedge and bond wire operatively associated therewith, is operatively connected to said terminal box.

4. An inert gas lighting system according to claim 3 in which each said cable means comprises a flex cable raceway having high voltage wire disposed therethrough, said wire being electrically connected at its proximal end to said electrode holder and at its distal end to the adjacent one of said binder posts in said terminal block.

5. An inert gas lighting system according to claim 1 in which said housing member and said terminal block are integrally formed of a non-combustible dielectric material selected from the group consisting of metal, glass, ceramic and a thermosetting V-5 fire resistant plastic materials.

6. For use in an inert gas lighting system intermediate adjacent lightable characters without requiring an external sign cabinet to protect said system from adverse weather conditions, a high tension terminal box comprising: a housing member having a sidewall and a bottom; access means defined through said sidewall in equispaced relationship to each other; a terminal block centrally disposed within said housing member is spaced insulated relationship to said sidewall, said terminal block having a pair of binder posts disposed therein in electrical communication therewith for separately connecting a first and a second cable member thereto to serially connect a pair of adjacent sign characters therethrough.

7. A high tension terminal box according to claim 6 in which each said cable member has a P-K style insulated electrode holder operatively secured to the proximal end thereof and a threaded flex connector adjacent the distal end thereof.

8. A high tension terminal box according to claim 7 in which said electrode holder is operatively connected to a tube in said sign character and said threaded flex connector having a ground wedge and bond wire operatively associated therewith is operatively connected to said terminal box.

9. A high tension terminal box according to claim 8 in which each said cable means comprises a flex cable raceway having high voltage wire disposed therethrough, said wire being electrically connected at its proximal end to said electrode holder and at its distal end to the adjacent one of said binder posts in said terminal block.

10. A high tension terminal box according to claim 6 in which said housing member and said terminal block are integrally formed of a non-combustible dielectric material selected from the group consisting of metal, glass, ceramic and a thermosetting V-5 fire resistant plastic materials.

11. A high tension terminal box according to claim 7 in which said housing member and said terminal block are integrally formed of a non-combustible dielectric material selected from the group consisting of metal, glass, ceramic and a thermosetting V-5 fire resistant plastic materials.

12. A high tension terminal box according to claim 8 in which said housing member and said terminal block are integrally formed of a non-combustible dielectric material selected from the group consisting of metal, glass, ceramic and a thermosetting V-5 fire resistant plastic materials.

13. A high tension terminal box according to claim 9 in which said housing member and said terminal block are integrally formed of a non-combustible dielectric material selected from the group consisting of metal, glass, ceramic and a thermosetting V-5 fire resistant plastic materials.

* * * * *